United States Patent [19]

Pracht

[11] Patent Number: 4,660,285

[45] Date of Patent: Apr. 28, 1987

[54] THINNING SCISSORS

[75] Inventor: Günther Pracht, Solingen, Fed. Rep. of Germany

[73] Assignee: Kurt Schmidt Fabrikation von Stahlwaren und chirurgischen Instrumenten (GmbH. & Co.), Solingen, Fed. Rep. of Germany

[21] Appl. No.: 837,638

[22] Filed: Mar. 10, 1986

[30] Foreign Application Priority Data

Jun. 18, 1985 [DE] Fed. Rep. of Germany ..... 3521688

[51] Int. Cl.[4] ..... B26B 19/22

[52] U.S. Cl. ..... 30/195; 30/200

[58] Field of Search ..... 30/131, 132, 134, 135, 30/200, 195, 230, 355

[56] References Cited

U.S. PATENT DOCUMENTS

| | | | |
|---|---|---|---|
| 887,494 | 5/1908 | Mulertz | 30/135 |
| 1,115,104 | 10/1914 | Prikla . | |
| 1,639,617 | 8/1927 | Seavey | 30/131 X |
| 2,272,580 | 2/1942 | Phillips | 30/195 |

FOREIGN PATENT DOCUMENTS

| | | | |
|---|---|---|---|
| 178803 | 4/1954 | Austria . | |
| 932476 | 9/1955 | Fed. Rep. of Germany . | |
| 1228160 | 11/1966 | Fed. Rep. of Germany . | |
| 699498 | 11/1953 | United Kingdom | 30/195 |

*Primary Examiner*—Douglas D. Watts

*Attorney, Agent, or Firm*—John C. Smith, Jr.

[57] ABSTRACT

When thinning scissors, in which the cutting edge of at least one scissor blade is serrated and the cutting edge of the other scissor blade is, for example, smooth, are used, visible steps detrimental to the appearance of the hair-style are obtained during thinning. To prevent the steps from being visible in the finished hair-style, one scissor blade of the thinning scissors has, on its outer side, a serration with stub teeth which overlies its cutting edge at a distance from the latter, the individual teeth projecting relative to the cutting edge of the scissor blade and having differing lengths.

6 Claims, 6 Drawing Figures

THINNING SCISSORS

BACKGROUND OF THE INVENTION

The invention relates to thinning scissors with one serrated cutting edge and one smooth cutting edge or with two serrated cutting edges.

When a cut is made with conventional thinning scissors provided, for example, with one serrated cutting edge and one smooth cutting edge, the hair grasped in strands by the thinning scissors is shortened by more or less the same length. This produces steps which are detrimental to the appearance of the hair-style. To prevent the steps, it is often preferable, for thinning, to use a razor, onto the blade of which is pushed a comb, the teeth of which project beyond the cutting edge of the razor blade. However, not only is a certain amount of dexterity required to handle a thinning instrument of this type, but it is also more time-consuming to thin by means of this instrument in comparison with thinning scissors. Moreover, the hair is split in a harmful way.

Thinning scissors with two serrated cutting edges are already known (German patent specification No. 932,476), and in these at least one scissor blade has a ground cutting edge at the bottom of each of the gashes. These thinning scissors are intended, in the first operation, to thin the hair roughly, that is to say not free of steps. In the second operation, the hair is then to be thinned out without steps, specifically solely by means of the scissor blade provided with the additional cutting edges. At the same time, the scissor blade is to be handled in a known manner in the same way as a razor with a comb pushed onto the blade. However, it becomes difficult to handle the scissor blade intended for thinning the hair without steps, because the other scissor blade has to be held in the position of rest during thinning. Thinning in two operations is also time-consuming.

In further known thinning scissors (German Auslegeschrift 1,228,160), for example the serrated cutting edge of a scissor blade is made corrugated, in order to cut off more hairs or fewer hairs from the strands grasped by the thinning scissors. If the scissors are rotated at an oblique angle relative to the direction of the hair strands, the uneven cutting of the hairs is intended also to be varied further, even to obtain differing hair lengths. Apart from the fact that the hair strands would not be thinned evenly, but in a highly variable manner, such thinning scissors are not even operable, specifically for the following reason. In any scissors, the scissor blades must touch one another with a certain pressure at the cutting edge, since a cutting effect is not obtained simply by sliding two cutting surfaces past one another. The pressing force at the point of contact between the cutting edges is generated as a result of the elastic resilience inherent in the scissor blades. When the thinning scissors are closed, the cutting edge of the non-serrated scissor blade, when it reaches a trough in the scissor blade having a corrugated serration, engages into the trough, with the result that, when the scissors are closed further, the non-serrated cutting edge comes up against the rising part of the trough and it is consequently impossible to close the scissors any further. The same applies to scissors in which the free ends of the teeth of the serrated scissor blade are arranged along a single elongate concave arc, since, when the scissors are closed, the cutting edge of the other scissor blade comes up against the front rising part of the arc, and again it is consequently impossible to close the scissors.

SUMMARY OF THE INVENTION

The object on which the invention is based is to design further thinning scissors of the generic type mentioned in the introduction, so that the hair is thinned by them in one operation, in such a way that the steps produced during thinning are not visible after thinning.

According to the invention, the object is achieved when (a) one scissor blade of the thinning scissors has, on its outer side, a serration with stub teeth which overlies its cutting edge at a distance from the latter, (b) the individual teeth project relative to the cutting edge of the scissor blade and have differing lengths.

The thinning scissors are applied to the hair to be thinned, in such a way that the serration overlying the cutting edge of one scissor blade at a distance faces the head of the person whose hair is to be cut. The hairs lying in front of the teeth of the serration are thereby held at different distances from the cutting edge of the scissor blade provided with the serration, with the result that the hair is cut in differing lengths when the scissors are closed. The thinned hairs are now no longer in a straight line, as before, but are distributed over the thinned region, so that the steps are no longer visible in the finished hair-style.

In an advantageous development of the invention, the serration is formed on a body which is produced separately and which is designed as a slide and is guided on a guide fixed to the scissor blade.

The advantage of the detachable connection between the serrated body and the scissor blade is that, if necessary, the cutting edge of the scissor blade can be resharpened without difficulty. Furthermore, after the serrated body has been detached from the scissor blade, the scissors can be used in the same way as conventional hair scissors.

In an advantageous embodiment of the invention, the guide for the body provided with the serration has a T-shaped cross-sectional form, and the counterstay on the body is a U-shaped groove with undercut edges.

BRIEF DESCRIPTION OF THE DRAWING

Two embodiments of the invention will now be described by way of example and with reference to the accompanying drawing in which.

DESCRIPTION OF THE PREFERRED EMBODIMENTS

Figure 1:
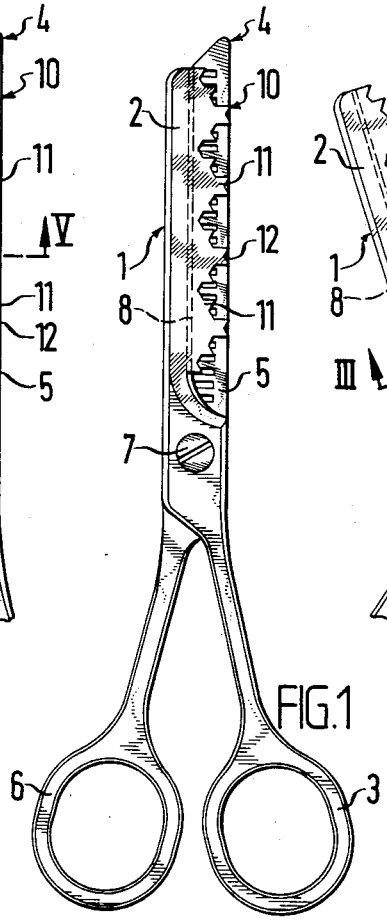
FIG. 1 is a front elevational view of closed thinning scissors according to the invention.
Figure 2:
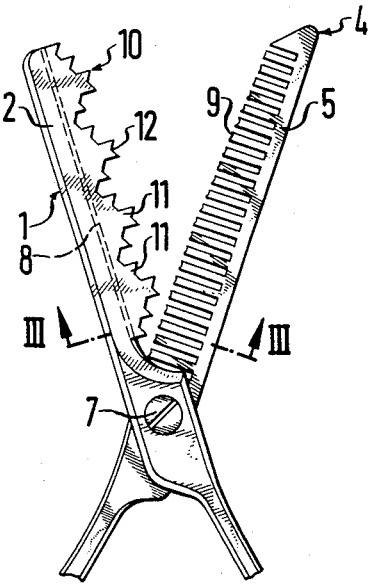
FIG. 2 is a fragmentary front elevational view of open thinning scissors.
Figure 3:
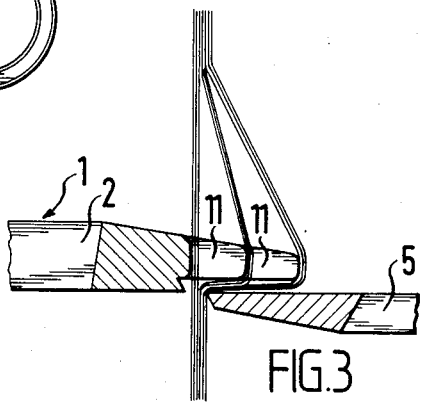
FIG. 3 is an enlarged cross-sectional view on line III—III of FIG. 2, with a hair strand grasped by the thinning scissors.

The reference numeral 1 of FIGS. 1 to 3 denotes one scissor half with a scissor blade 2 and a ring handle 3, and the reference numeral 4 denotes the other scissor half with a scissor blade 5 and a ring handle 6. The scissor halves 1 and 4 are connected to one another by means of a joint screw 7. The scissor blade 2 has a smooth cutting edge 8, and the scissor blade 5 has a serrated cutting edge 9.

The scissor blade 2 of the thinning scissors illustrated in FIGS. 1 to 3 has, on its outer side, a serration 10 with stub teeth 11 which is formed on it. The serration 10 overlies the smooth cutting edge 8 of the scissor blade 2 at a distance from the cutting edge 8. The individual teeth 11 of the serration 10 have V-shaped notches 12 on their end faces, to prevent the hairs from slipping off from the teeth 11. They project relative to the cutting edge 8, specifically in varying lengths.

Figure 6:
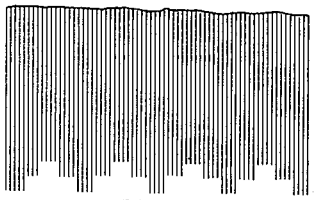
FIG. 6 shows a hair strand thinned by means of the thinning scissors.
Figure 4:
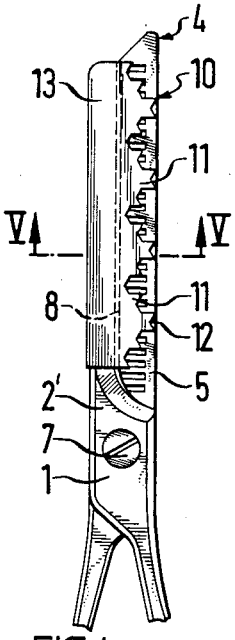
FIG. 4 is a fragmentary front elevational view of closed thinning scissors according to another embodiment of the invention.
Figure 5:
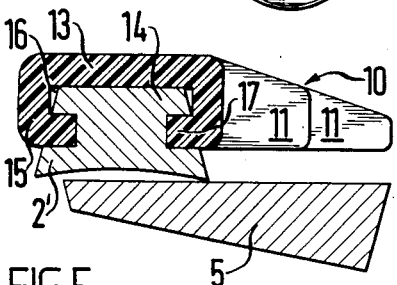
FIG. 5 is an enlarged cross-sectional view on line V—V of FIG. 4.

In the alternative embodiment of the thinning scissors illustrated in FIGS. 4 and 5, the serration 10 is formed on a body 13 which is separately produced, preferably from plastic, and which is designed as a slide. This body 13 is guided on a projecting guide 14 of T-shaped cross section which is integral with a scissor blade $2^1$ and which has a counterstay 15. The counterstay 15 consists of a groove 16 with undercut edges 17.

It is of course within the scope of the invention to make both cutting edges of the thinning scissors either smooth or serrated.

The invention may be embodied in other specific forms without departing from the spirit or essential characteristics thereof. The embodiments are therefore to be considered in all respects as illustrative and not restrictive.

What is claimed is:

1. Hair thinning scissors adapted to cut selected strands of hair in differing lengths comprising:

(a) a pair of first and second elongated scissor blades each having an inner side, an outer side, a cutting edge, and manual gripping means, at least one of said cutting edges being serrated;

(b) means for pivotally securing said first and second scissor blades to each other with said inner sides facing towards each other such that said cutting edges cooperate with each other to cut hair when said first and second scissor blades are manually, pivotally moved towards each other from an open position to a closed position;

(c) elongated hair guide means extending along the outer side of said first scissor blade and having a leading edge projecting laterally beyond said cutting edge of said first scissor blade toward said second scissor blade when said scissor blades are in said open position, said leading edge of said guide means being configured to provide a plurality of hair retaining surfaces extending along the length of said guide means, the distances between adjacent of said plurality of hair retaining surfaces and said cutting edge of said first scissor blade being different;

(d) whereby, when a plurality of strands of hair are positioned between said scissor blades and along said leading edge of said guide means and said scissor blades are pivotally moved progressively toward said closed position to thin said plurality of strands of hair, at least selected of said strands of hair will first be contacted between said plurality of hair retaining surfaces and said cutting edge of said second scissor blade and then varying lengths of said at least selected strands of hair will pass between said inner side of said second blade and said guide means before said cutting edges of said first and second scissor blades contact each other and cut selected of said strands of hair at spaced locations to different lengths.

2. Hair thinning scissors according to claim 1 wherein said cutting edge of said first scissor blade is linear and said cutting edge of said second scissor blade is serrated.

3. Hair thinning scissors according to claim 1 wherein each of said hair retaining surfaces comprises a notch in said leading edge of said guide means for retaining selected strands of hair as said first and second scissor blades are pivoted towards said closed position.

4. Hair thinning scissors according to claim 1 wherein said outer side of said first scissor blade comprises at least one elongated recess therein and said guide means comprises at least one elongated projection adapted to be retained in said recess to detachably secure said guide means to said first scissor blade.

5. Hair thinning scissors according to claim 4 wherein said outer side of said first scissor blade comprises a ridge having an elongated generally T-shaped cross-sectional configuration with at least one of said elongated recesses at opposite sides thereof and said guide means includes an elongated channel having a cross-sectional configuration complementary to said ridge of said outer side of said blade with elongated projections at opposite sides of said channel for engaging the respective of said recesses in said opposite sides of said ridge.

6. Hair thinning scissors adapted to cut selected strands of hair in differing lengths comprising:

(a) a pair of first and second elongated scissor blades each having an inner side, an outer side, a cutting edge, and manual gripping means, at least one of said cutting edges being serrated;

(b) means for pivotally securing said first and second scissor blades to each other with said inner sides facing towards each other such that said cutting edges cooperate with each other to cut hair when said first and second scissor blades are manually, pivotally moved towards each other from an open position to a closed position along a plane;

(c) a plurality of hair-retaining surfaces arranged along the length of said first scissor blade and spaced from said plane, the distances between adjacent of said plurality of hair-retaining surfaces and said cutting edge of said first scissor blade being different;

(d) such that when a plurality of strands of hair extend over said plurality of hair-retaining surfaces and between said scissor blades and said scissor blades are pivotally moved progressively towards said closed position to thin said plurality of strands of hair, the lengths of adjacent portions of said plurality of strands of hair extending between said plurality of hair-retaining surfaces and said cutting edge of said first scissor blade are different.

* * * * *